US009887475B2

(12) United States Patent
Loy

(10) Patent No.: US 9,887,475 B2
(45) Date of Patent: Feb. 6, 2018

(54) HELICAL SPRING BACKPLANE CIRCUIT BOARD CONNECTOR

(71) Applicant: Honeywell International Inc., Morris Plains, NJ (US)

(72) Inventor: Garry M. Loy, Raleigh, NC (US)

(73) Assignee: Honeywell International Inc., Morris Plains, NJ (US)

( * ) Notice: Subject to any disclaimer, the term of this patent is extended or adjusted under 35 U.S.C. 154(b) by 0 days.

(21) Appl. No.: 15/373,693

(22) Filed: Dec. 9, 2016

(65) Prior Publication Data

US 2017/0170586 A1 Jun. 15, 2017

Related U.S. Application Data

(60) Provisional application No. 62/265,343, filed on Dec. 9, 2015.

(51) Int. Cl.

| | |
|---|---|
| ***H01R 13/33*** | (2006.01) |
| ***H01R 12/72*** | (2011.01) |
| ***H01R 13/24*** | (2006.01) |
| ***H01R 43/20*** | (2006.01) |

(52) U.S. Cl.

CPC ..... *H01R 12/728* (2013.01); *H01R 13/2442* (2013.01); *H01R 13/33* (2013.01); *H01R 43/205* (2013.01)

(58) Field of Classification Search

CPC ... H01R 12/728; H01R 43/16; H01R 13/2442
USPC ..... 439/82, 751
See application file for complete search history.

(56) References Cited

U.S. PATENT DOCUMENTS 7,051,432 B2 * 5/2006 Loy ..... B23K 1/0008 29/739

* cited by examiner

*Primary Examiner* — Harshad C Patel
(74) *Attorney, Agent, or Firm* — Baker & Hostetler LLP

(57) ABSTRACT

A low-cost electrical connector that is capable of providing a single or a multiplicity of continuous electrical connections between two individual printed circuit boards, and method of making thereof.

18 Claims, 5 Drawing Sheets

HELICAL SPRING BACKPLANE CIRCUIT BOARD CONNECTOR

CROSS REFERENCE TO RELATED APPLICATIONS

The present application claims the benefit of U.S. Provisional Patent Application No. 62/265,343, filed on Dec. 9, 2015, entitled "HELICAL SPRING BACKPLANE CIRCUIT BOARD CONNECTOR," the entire contents of this application is herein incorporated by reference into this application for all purposes.

BACKGROUND

There are a variety of electrical connectors adapted to provide continuous electrical circuits between two individual printed circuit boards oriented at right or oblique angles to one another when assembled. The connectors are generally used for two different types of electrical connections—power level and signal level. Power level connections typically have higher voltage and higher current that removes oxidation by burning it off, which assists in maintaining the contact integrity. Signal level connections, however, have very low amplitude current that would be measured in microamps up to a few milliamps (e.g., approximately 30 μA to 30 mA) and/or low-voltage (e.g., approximately 2V to 5V). If a signal level connection does not maintain sufficient force at the points of contact, environmental factors may cause oxidation and corrosion at the point of contact, which could interfere with the electrical connection.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

An electrical assembly disclosed herein may include a circuit board that contains a top surface, an opposed bottom surface, a front edge, and a plurality of holes that extend from the top surface through to the bottom surface and are disposed in a row along and parallel to the front edge. In addition, at least a portion of a helical spring is disposed within the plurality of holes and configured to contact one or more conductive pads on a surface of an other circuit board, thereby placing the circuit board in electrical communication with the other circuit board.

A method for creating an electrical assembly may include threading a helical spring containing a first end, a second and a plurality of coils into a plurality of holes disposed in a row parallel to an edge of a circuit board, wherein at least one of the plurality of holes is plated with an electrically conductive material. The helical spring is then soldered to the circuit board where the helical spring passes through at least one plated hole. Optionally, a section is removed from each coil in the helical spring.

BRIEF DESCRIPTION OF THE DRAWINGS

The foregoing summary, as well as the following detailed description of various embodiments, is better understood when read in conjunction with the appended drawings. For the purpose of illustration, there are shown in the drawings exemplary embodiments of various aspects of a connector; however, the disclosure is not limited to the specific methods and instrumentalities disclosed. In the drawings.

DETAILED DESCRIPTION OF ILLUSTRATIVE EMBODIMENTS

Some electrical connectors incorporate an insulator housing component made from plastic or other dielectric material to separate and position the individual contacts. In some instances, the housing serves to generate sufficient contact pressure to maintain the contact integrity for a signal level connection. In other cases, such connectors require some external means to generate contact pressure. Regardless, these connectors may be expensive because they contain numerous parts that must be assembled to create the final electrical connector.

Described herein is a helical spring connector that may be used to provide a single or a multiplicity of continuous power or signal level electrical connections between two individual printed circuit boards when the two circuit boards are assembled into a suitable housing or structure for their intended purpose. Embodiments of the helical spring connector are described below with reference to FIGS. 1-6. The helical spring connector is described in detail for exemplary purposes only. The descriptions given herein with respect to those figures is not intended in any way to limit the scope of potential embodiments.

Figure 1:
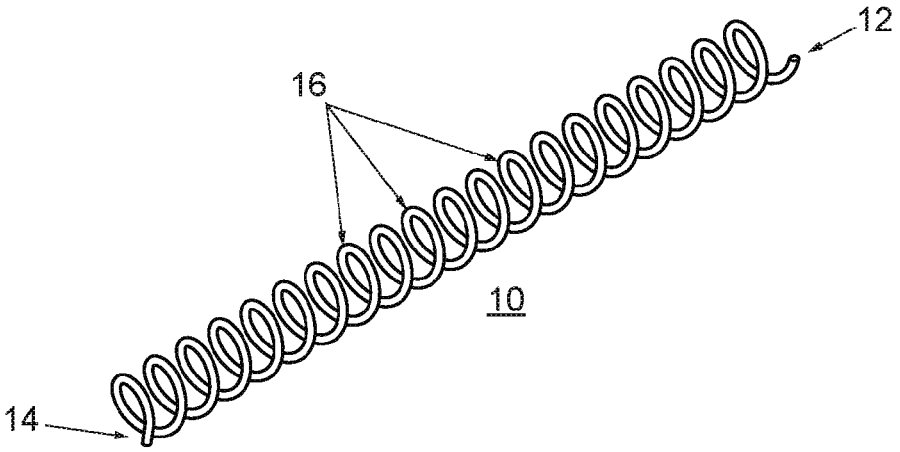
FIG. 1 is a perspective view of a helical spring according to an embodiment of the present disclosure.
Figure 2:
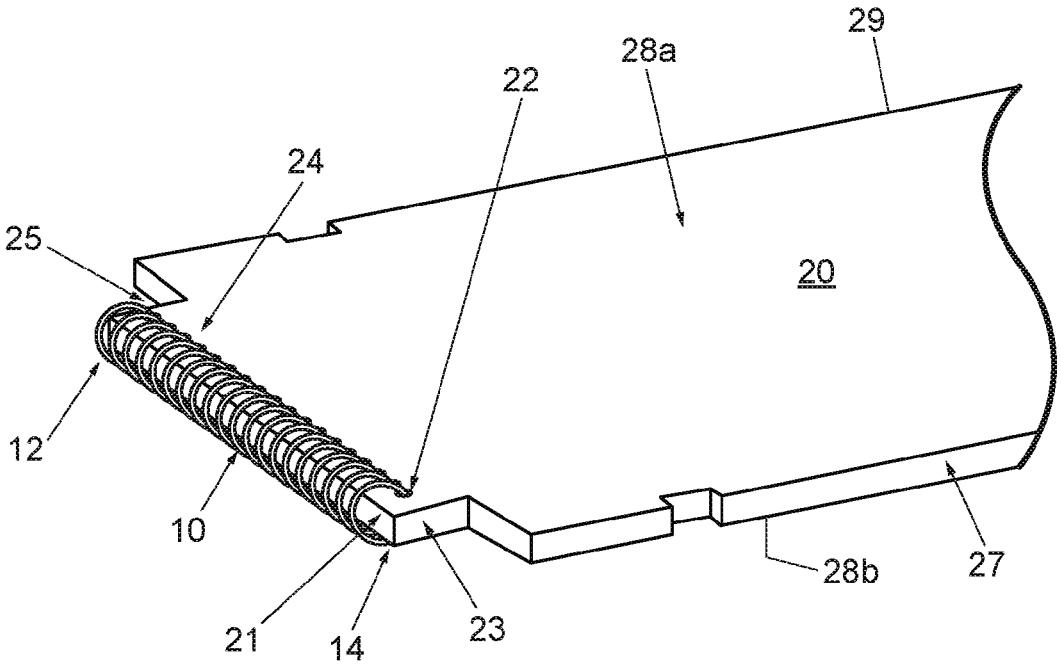
FIG. 2 is a perspective view of a daughter board with an installed helical spring connector according to an embodiment of the present disclosure.

FIGS. 1 and 2 show a helical wound compression spring ("helical spring") 10, comprising a first end 12, second end 14 and a plurality of coils 16. In one or more embodiments, the helical spring 10 may be used to form a single or multiplicity of continuous electrical circuit connections between two individual printed boards, effectively serving as an electrical connector. The spring pitch, or distance between coils, may vary depending upon the application. For example, a signal-level connection may have a smaller pitch or closer spacing between spring coils, whereas, a power-level connection may have greater pitch, or further spacing between spring coils.

The spring material and geometry may be selected based on application structural and mechanical requirements. In one embodiment, the cross-section of the helical spring wire is circular which may help to lower cost. In other embodiments, however, the cross-section of the spring wire is not limited to any particular cross-section. The helical spring wire dimensions may be selected to achieve the proper deflection and compression after installation to create sufficient normal force at the point of contact to prevent oxidation and maintain a suitable electrical connection. In addition, the helical spring 10 may be plated to achieve the necessary electrical conductivity and/or corrosion protection. For example, the helical spring 10 may be completely or selectively gold plated in order to provide suitable connections for low level signals. In other embodiments, other conductive coatings may be employed, such as tin, tin-lead alloys, copper, or nickel. In one embodiment, the helical spring 10 is made from conductive wire. For example, the conductive wire material may be an alloy such as phosphor bronze or beryllium copper. In an alternative embodiment, the helical spring 10 is made from stainless steel coated with another material, such as copper under nickel or tin, to improve conductivity.

Figure 5:
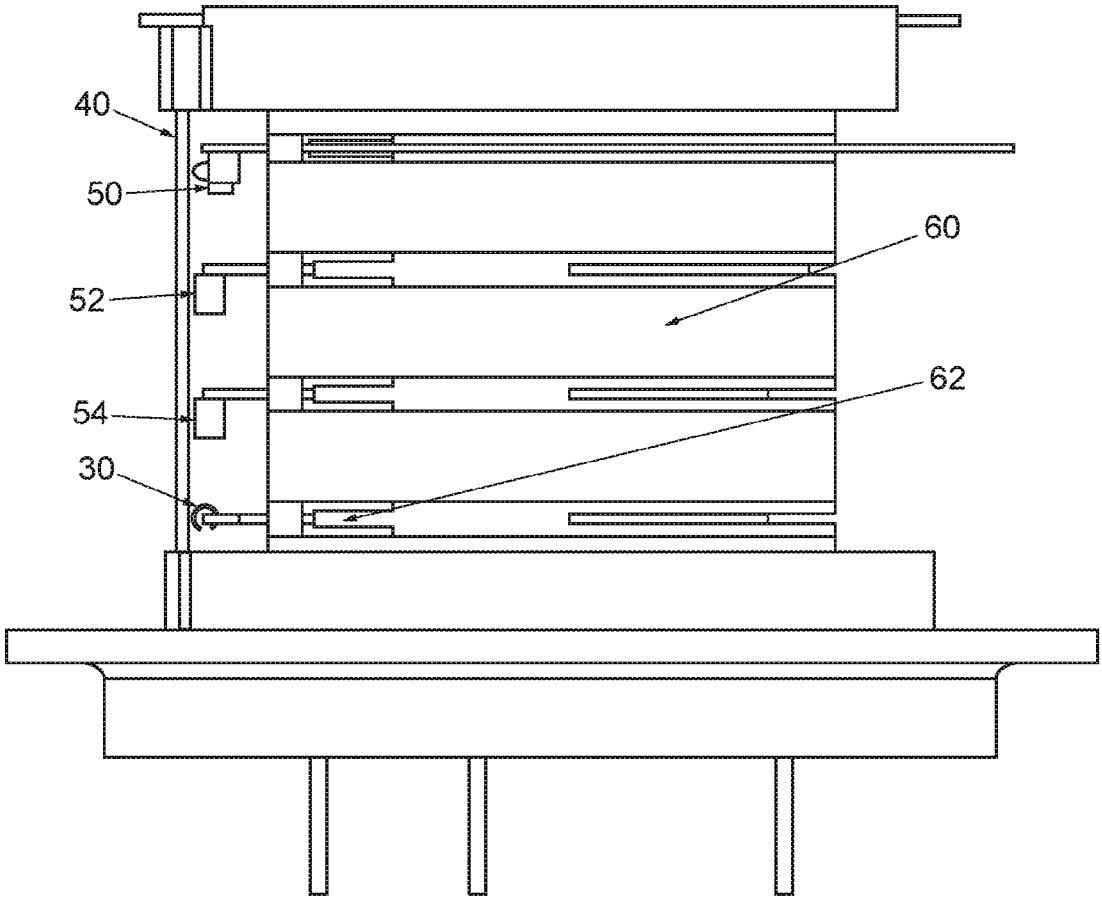
FIG. 5 shows a meter assembly with different types of 90 degree daughter board connectors, including the helical spring connector containing multiple contact segments.
Figure 6:
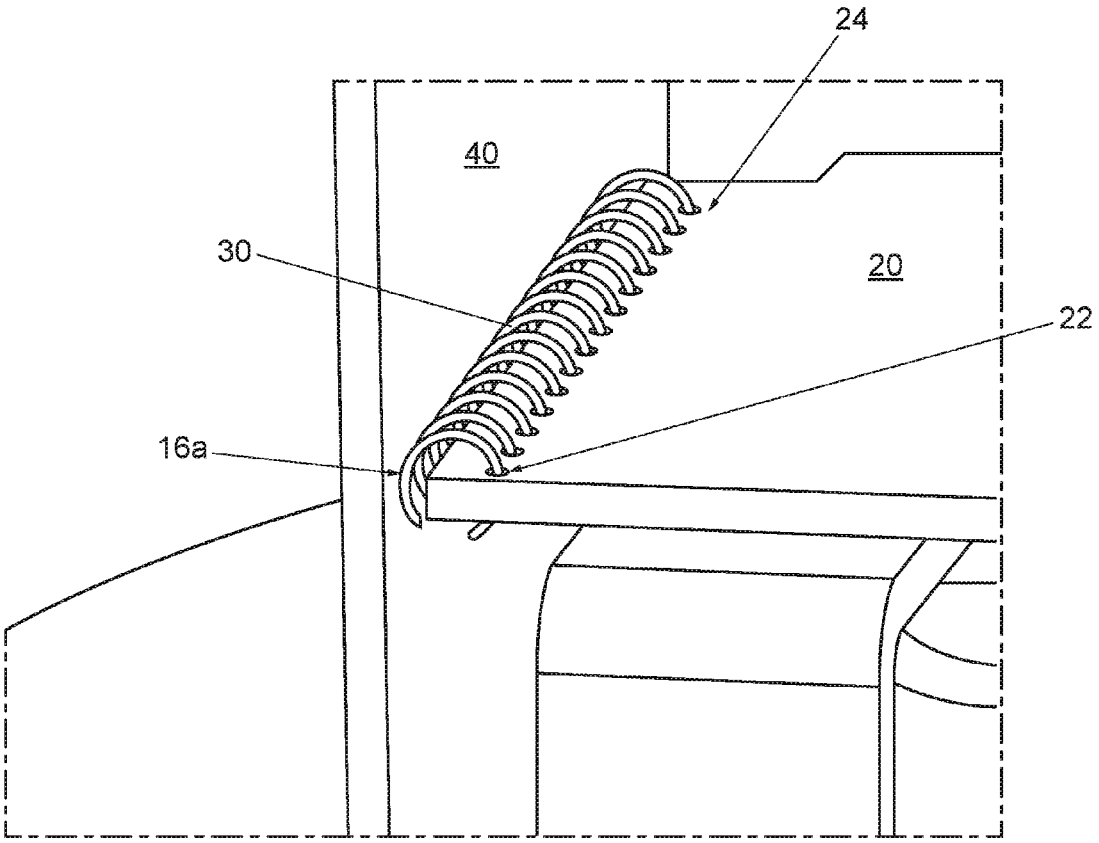
FIG. 6 is a section view that shows an installed daughter board with a helical spring connector containing multiple contact segments mated to a backplane board according to an embodiment of the present disclosure.

Referring to FIGS. 5 and 6, the first of the two circuit boards may be considered stationary, or fixed, and shall be referred to herein—for ease of description only—as the backplane or backplane board 40. In some embodiments, the backplane board may not actually be fixed or stationary but is referred to as fixed simply because it is installed or assembled first. The second circuit board will be referred to herein—again for ease of description only—as the daughter board 20.

Figure 3:
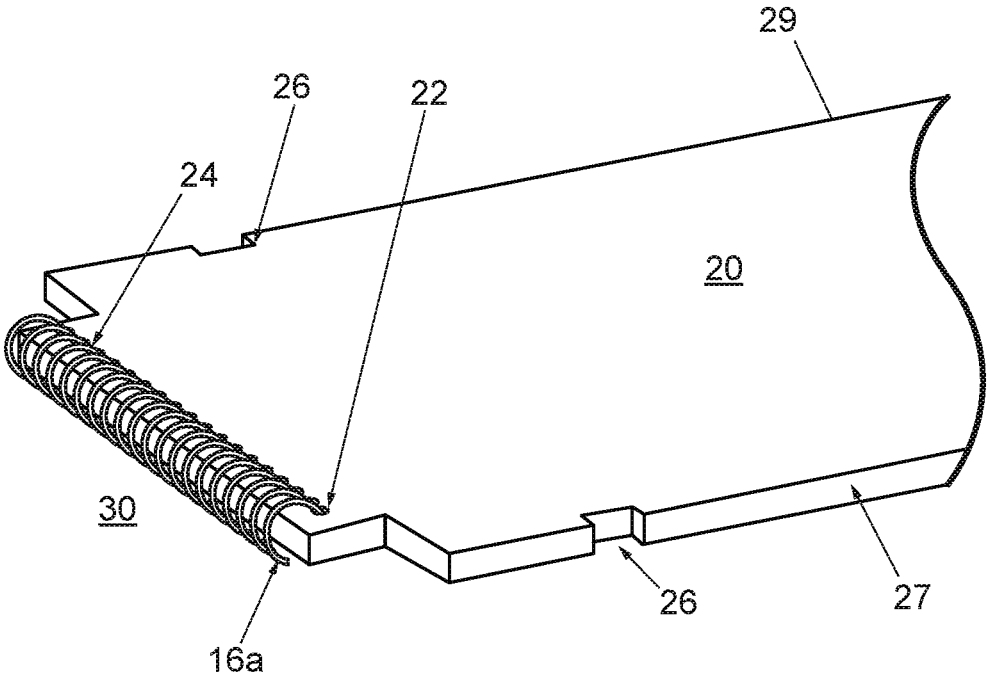
FIG. 3 is a perspective view of a daughter board with a helical spring connector containing multiple contact segments according to an embodiment of the present disclosure.

As shown in the embodiment of FIG. 2, the daughter board 20 has a top surface 28*a*, an opposed bottom surface 28*b*, a front edge 21, and a plurality of holes 22, 24 that extend from the top surface through to the bottom surface and are disposed in a row along and parallel to the front edge 21. As discussed below, the holes 22, 24 may be plated with a conductive material, thereby creating a through-plated hole. The daughter board 20 further includes a first side 27 and a second side 29 that may be oriented substantially perpendicular to the front edge 21. As shown in FIGS. 3 and 5, the first side 27 and/or the second side 29 may contain a notch 26 sized and shaped to accept a locking tab 62 in a daughter board housing 60.

Referring to FIG. 2, the helical spring 10 is installed along at least one edge of the daughter board. The helical spring 10 passes through holes 22, 24 in the daughter board 20, which place the coils 16 in electrical contact with at least one circuit (not shown) on the daughter board 20. In one embodiment shown in FIGS. 3-6, sections of the plurality of coils 16 are removed to create the helical spring connector 30, which contains a plurality of individual contact segments 16*a*.

Referring to FIG. 6, upon assembly, the daughter board 20 may be oriented substantially perpendicular to the backplane board 40. The backplane board 40 may contain at least one circuit (not shown) that is in electrical contact with at least one conductive pad (not shown) on the mating surface of the backplane board to complete the electrical connection between the backplane board 40 and daughter board 20 by physical contact with the helical spring connector 30, which is disposed along the edge of the daughter board that is adjacent to the backplane board 40. As such, the electrical connection is dependent upon the relative position or proximity of the two boards to each other, and the two boards may be separated to interrupt the electrical connection or brought together to make the connection.

Figure 4:
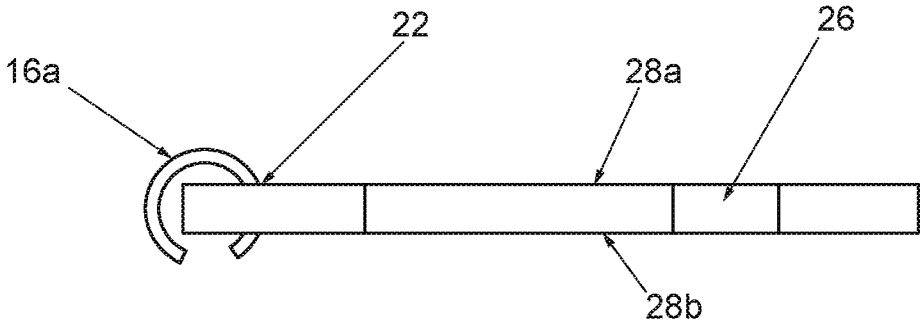
FIG. 4 is an edge view of the daughter board in FIG. 3 that shows an installed contact segment according to an embodiment of the present disclosure.

In one embodiment, the daughter board 20 has the helical spring connector 30 permanently installed by the following steps:

1) Referring to FIG. 2, the daughter board 20 contains a row of holes 22, 24. The holes 22, 24 pass through the board and are parallel to the edge 21 of the board that is to contain the helical spring connector 30. The holes 22, 24 may be plated with a conductive material and are in contact with at least one circuit (not shown) on the daughter board 20. The distance from the edge of the board to the holes and the distance between the holes may be adjusted depending on application design parameters. The helical spring 10 is threaded into the row of holes 22, 24 in the daughter board 20. The helical spring first end 12 is inserted into a hole at the daughter board proximal side 23. As the helical spring 10 is rotated, the first end 12 advances toward the daughter board distal side 25, and passes through, successive holes 22, 24. The helical spring 10 may be installed by hand, or installation may be automated by using a machine that quickly and efficiently "screws" the helical spring 10 into the holes 22, 24 in the daughter board 20.
2) The helical spring 10 is then soldered to the daughter board 20 where it naturally contacts any plated hole 22, 24. Exemplary soldering processes include wave soldering or solder paste and reflow.
3) As best shown in FIGS. 3 and 4, the helical spring connector 30 contains a plurality of individual contact segments 16*a*, which may be created by removing a section from each of the plurality of coils 16 in the helical spring 10. The section of each coil 16 may be removed, for example, by a cutting process. The cutting process may be automated and use a cutting die designed to make all cuts simultaneously. Use of a cutting die may provide an efficient, fast, low-cost process for removing a section from each of the plurality of coils 16 in the helical spring 10.

In another embodiment, the helical spring connector may be created by first threading the helical spring 10 into the holes 22, 24 in the daughter board 20, and then soldering the helical spring 10 to the daughter board 20 where it contacts any plated hole 22, 24. However, the helical spring 10 is left intact and no sections are removed from the plurality of coils, thereby creating a connector with a single continuous contact.

In another embodiment, the helical spring connector may be created by using a selectively plated or selectively coated helical spring. For example, it is not normally acceptable practice to solder gold plated wire leads with a typical tin-lead alloy solder. Accordingly, the helical spring 10 may be plated such that the contact portions of the plurality of coils are gold plated, while at least the portions of the plurality of coils to be soldered to the daughter board are not gold plated. An exemplary selective plating process may include controlling the depth that the helical spring plurality of coils is immersed in the plating bath. The selective plating process may further include feeding a long continuous helical spring around a type of wheel directly over the plating bath. The selectively-plated long continuous helical spring may then be cut to the desired length. Such an exemplary process may control the gold plated portions of the plurality of coils in the selectively plated helical spring. The helical spring connector may then be created by threading the selectively plated helical spring into the holes 22, 24 in the daughter board 20 such that non-gold plated portions of the plurality of coils pass through and align with the holes 22, 24 in the daughter board 20 prior to the soldering process. The helical spring may then be soldered to the daughter board 20 where the non-gold plated portions of the plurality of coils contact any plated holes 22, 24 using a soldering process that allows the solder to be directed only to the non-gold plated portions of the plurality of coils (e.g., a solder fountain). A cutting process as previously described may then be used to remove a section from each of the plurality of coils to create a plurality of contact segments.

Figure 7B:
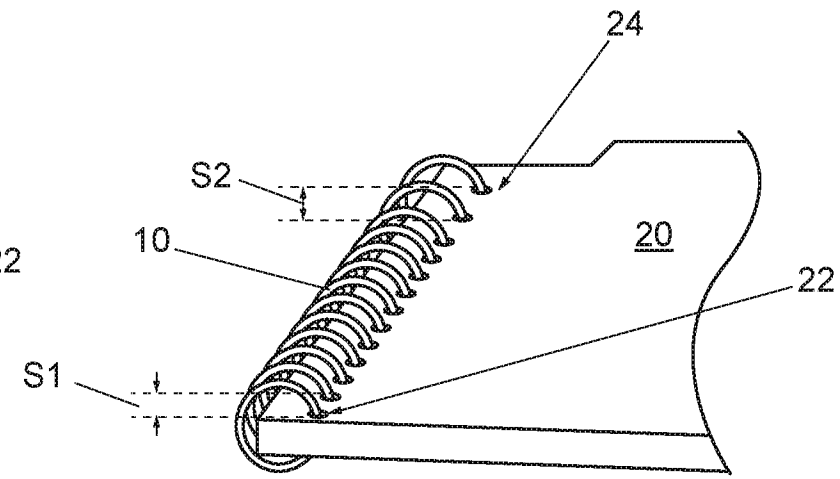
FIG. 7B is a perspective view of a daughter board with an installed helical spring connector according to another embodiment of the present disclosure.
Figure 7A:
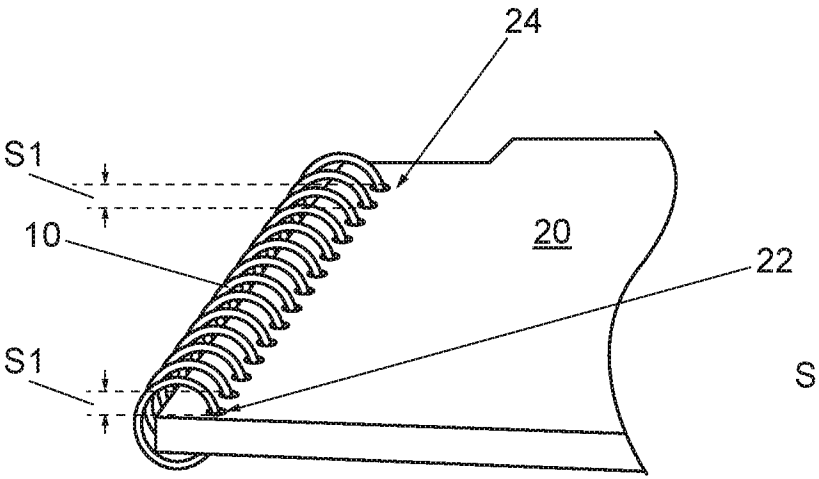
FIG. 7A is a perspective view of a daughter board with an installed helical spring connector according to an embodiment of the present disclosure.

Referring to FIG. 7A, in one embodiment, the row of holes 22, 24 in the daughter board 20 are evenly spaced from each other (e.g., S1) according to the pitch of the mating helical spring. As shown in FIG. 7B, in an alternative embodiment, the row of holes in the daughter board may contain at least two sets of holes with different spacing between the holes in each respective set of holes (e.g., S1, S2). The first set of holes 22 may be located near the proximal side 23 of the daughter board where the helical spring first end 12 is initially inserted into the row of holes in the daughter board during assembly. The second set of holes 24 may be located near the distal side 25 of the daughter board. The first set of holes 22 may be configured to be evenly spaced (e.g., S1) and to match the pitch of the helical spring. The second set of holes 24 may be spaced (e.g., S2) such that they are slightly greater than or less than the pitch of the helical spring. Note that the second set of holes 24 greater spacing S2 shown in FIG. 7B is exaggerated for illustrative purposes. During insertion of the helical spring 10, the helical spring first end 12 may freely advance through the first set of holes 22 because the hole spacing is configured to match the helical spring pitch. However, the spacing of the second set of holes may be configured to create interference as the helical spring first end 12 passes through holes in the second set of holes 24, thereby creating friction to hold the helical spring 10 in place during the soldering process.

In one embodiment, all of the holes 22, 24 in the daughter board 20 are plated. In an alternative embodiment, the holes 22, 24 are selectively plated depending on the desired spacing between the plurality contact segments 16*a* in the completed helical spring connector 30. During the soldering step, any of the plurality of coils 16 that pass through a non-plated hole will not be attached to the daughter board 20 by the soldering step. Accordingly, the non-plated holes will not contain contact segments after the cutting step.

The selectively plated hole embodiment discussed above provides many design advantages. For example, it may allow for greater spacing between each contact segment than the original helical spring pitch. It may also allow for the creation of multiple groups of contact segments with spacing between each group that is greater than the helical spring pitch. The greater spacing between the contact segments, or groups of contact segments, would create greater dielectric strength between the individual contact segments, or the groups of contact segments.

In a further embodiment, selectively plating holes may allow for voltage and signal connections on the same edge of the daughter board using one helical spring. Voltage-level connections may require a greater distance between contact segments. In contrast, signal-level connections may require closer spacing between contact segments, which may be achieved by using a helical spring with a smaller pitch. Selectively plating holes may allow for voltage and signal connections on the same edge of the daughter board by using one helical spring and adjusting the spacing between particular contact segments. The holes may be sized and spaced to accept a helical spring with dimensions that satisfy the signal-level connection design requirements and the holes may be selectively plated based on the type of connection desired at the particular location on the edge of the daughter board. The signal-level connector portion may be created by a series of plated holes located next to each other. The voltage-level connector portion may contain one or more non-plated holes between the plated holes. During the soldering process, the portion of the helical spring that passes through plated holes may be permanently attached to the daughter board. In contrast, the portion of the helical spring that passes through non-plated holes may not be permanently attached to the daughter board. After the cutting process, the segments that are not permanently attached to the daughter board may be removed.

In another embodiment, the holes 22, 24 in the daughter board 20 may be selectively plated and in the cutting step, only portions of the coils that pass through non-plated holes are removed, thereby creating a connector with multiple continuous contacts.

FIG. 5 illustrates a watt-hour electrical energy meter assembly in which the daughter board 20 is also represented as one or more option boards that contain various right angle circuit board connectors 50, 52, 54. Connector 50 is representative of commercial compression connectors, e.g., a Samtec SIR1 series connector, that comprise an assembly of an insulator housing made from plastic or other dielectric material, a plurality of individual contacts, and a plurality of individual solder tails. The housing holds the contacts and solder tails in the correct orientation. The solder tails connect the assembly to the daughter board, and the electrical connection is created when the individual contacts are pressed against a conductive pad or conductive surface on a backplane board that is oriented at a right angle to the daughter board. As such, the connection for this type of connector requires an external clamping force to keep the individual contacts pressed against the opposing conductive pad or surface. Due to the nature of the connection—compressing a contact against an opposing conductive pad or surface, this type of connector is more forgiving for alignment between the two boards. However, the connector may be expensive because it contains numerous parts that must be assembled.

Connectors 52, 54 are generic representations of right angle connectors that have rows of pins on one board and a corresponding socket attached to the mating board. The pins must engage the socket to create a connection. Once connected, the socket provides positive clamping force on the pins and, as a result, this style connector does not require an external retaining force. However, alignment is critical for the performance of this style connector. Any misalignment could bend a pin. In addition, if the connector does not have a funnel shape or some other type of large lead-in entry chamfer, the pin may be bent upon insertion. And similar to connector 50, connectors 52, 54 also require plastic or some other dielectric material to separate and hold the individual contacts in the correct position.

With the helical spring connector 30 described herein, alignment is not critical. As seen in FIG. 6, the contact segments 16*a* mate with at least one conductive pad (not shown) on the backplane board 40. The contact segments 16*a* simply need to press against the mating conductive pad with at least the minimal requisite normal force necessary to maintain the desired type of electrical connection. Further, any slight lateral shift in position between the daughter board 20 and backplane board 40 would not affect performance of the electrical connection, so long as the contact segments 16*a* remain in contact with the conductive pad with the requisite normal force.

In an embodiment, external mechanical features are provided to create the desired contact pressure for the electrical connection. For example, as seen in FIGS. 3-5, this may be created using locking tabs 62 on the daughter board housing 60 and notches 26 on the daughter board 20. The locking tabs tabs 62 are sized and shaped to fit within the notches 26 in daughter board 20 and configured to retain the daughter board 20 within the daughter board housing 60. The mechanical features may be designed to preload the contact segments 16*a* with the necessary normal force against the backplane conductive pad to create an environmentally robust connection that has sufficient force at the point of contact to prevent oxidation and maintain a suitable electrical connection.

The helical spring connector 30 may have a lower cost than other connectors. The helical spring connector 30 may also have a reduced part cost because plastic or other dielectric material may not be needed to hold the contacts in the proper orientation. Additionally, since the plastic or other dielectric material parts may not be required, there may be no associated assembly labor for those components.

While example embodiments and advantages have been described above, modifications and variations may be made without departing from the principles described above and set forth in the following claims. Accordingly, reference should be made to the following claims as describing the scope of the claimed subject matter.

What is claimed:

1. An electrical assembly comprising:

a circuit board containing a top surface, an opposed bottom surface, a front edge, and a plurality of holes that extend from the top surface through to the bottom surface and are disposed in a row along and parallel to the front edge; and at least a portion of a helical spring disposed within the plurality of holes and configured to contact one or more conductive pads on a surface of an other circuit board, thereby placing the circuit board in electrical communication with the other circuit board.

2. The electrical assembly of claim 1, wherein the at least the portion of the helical spring further comprises a plurality of helical spring segments.

3. The electrical assembly of claim 1, wherein the helical spring comprises phosphor bronze.

4. The electrical assembly of claim 1, wherein the helical spring comprises beryllium copper.

5. The electrical assembly of claim 2, wherein at least a portion of the plurality of helical spring segments is plated with a material to improve electrical conductivity.

6. The electrical assembly of claim 5, wherein the plating material is selected from a group including gold, tin, tin-lead alloys, copper, and nickel.

7. The electrical assembly of claim 1, wherein the circuit board comprises at least one notch configured to retain the circuit board in a housing.

8. The electrical assembly of claim 1, wherein the plurality of holes are evenly spaced.

9. The electrical assembly of claim 1, wherein the plurality of holes further comprises a first group of holes with a first spacing and a second group of holes with a second spacing that is different than the first spacing.

10. A method for creating an electrical connector, the method comprising:

threading a helical spring comprising a first end, a second end, and a plurality of coils into a plurality of holes disposed in a row parallel to an edge of a circuit board, wherein at least one of the plurality of holes is plated with an electrically conductive material; and soldering the helical spring to the circuit board where the helical spring passes through the at least one plated hole.

11. The method of claim 10, further comprising removing a section from each coil in the helical spring.

12. The method of claim 10, wherein the plurality of holes are evenly spaced.

13. The method of claim 10, wherein the plurality of holes further comprises a first group of holes with a first spacing and a second group of holes with a second spacing that is different than the first spacing.

14. The method of claim 10, further comprising plating at least a portion of the helical spring with a plating material to improve electrical conductivity prior to threading the helical spring into the plurality of holes.

15. The method of claim 14, wherein plating the at least a portion of the helical spring further comprises controlling a depth that the plurality of coils of the helical spring are immersed in a bath of the plating material to improve electrical conductivity.

16. The method of claim 10, wherein the plating material is selected from a group including gold, tin, tin-lead alloys, copper, and nickel.

17. The method of claim 14, wherein threading further comprises aligning non-plated portions of the helical spring within the plurality of holes.

18. The method of claim 10, wherein soldering comprises one of wave soldering, solder paste and reflow, or a solder fountain.

* * * * *